US005591003A

United States Patent [19]

Boyd et al.

[11] Patent Number: 5,591,003

[45] Date of Patent: Jan. 7, 1997

[54] TURBINE NOZZLE/NOZZLE SUPPORT STRUCTURE

[75] Inventors: Gary L. Boyd, Alpine, Calif.; James E. Shaffer, Maitland, Fla.

[73] Assignee: Solar Turbines Incorporated, San Diego, Calif.

[21] Appl. No.: 427,540

[22] Filed: Jun. 14, 1995

Related U.S. Application Data

[62] Division of Ser. No. 166,188, Dec. 13, 1993, Pat. No. 5,441,385.

[51] Int. Cl.[6] ..... F04D 29/44

[52] U.S. Cl. ..... 415/209.2; 415/209.3

[58] Field of Search ..... 415/208.1, 189, 415/190, 200, 209.2, 209.3

[56] References Cited

U.S. PATENT DOCUMENTS

| | | | |
|---|---|---|---|
| 2,625,367 | 1/1953 | Rainbow | 415/209.3 |
| 3,319,930 | 5/1967 | Howard | 415/190 |
| 3,363,416 | 1/1968 | Heybyrne et al. . | |
| 3,843,279 | 10/1974 | Crossley et al. | 415/191 |
| 3,996,353 | 6/1976 | Boother, Jr. et al. | 415/115 |
| 4,260,327 | 4/1981 | Armor et al. | 415/189 |
| 4,492,517 | 1/1985 | Klompas | 415/115 |
| 4,815,933 | 3/1989 | Hansel et al. | 415/137 |
| 4,883,405 | 11/1989 | Walker | 415/137 |
| 5,211,536 | 5/1993 | Ackerman et al. | 415/177 |
| 5,441,385 | 8/1995 | Boyd et al. | 415/209.2 |

FOREIGN PATENT DOCUMENTS

| | | |
|---|---|---|
| 1035662 | 8/1958 | Germany . |
| 532372 | 1/1941 | United Kingdom . |
| 1387866 | 3/1975 | United Kingdom . |

*Primary Examiner*—John T. Kwon
*Attorney, Agent, or Firm*—Larry G. Cain

[57] ABSTRACT

An axial flow turbine's nozzle/nozzle support structure having a cantilevered nozzle outer structure including an outer shroud and airfoil vanes extending radially inwardly therefrom, an inner shroud radially adjacent the inner end of the airfoil vanes and cooperatively disposed relative to the outer shroud to provide an annular fluid flow path, an inner and an outer support ring respectively arranged radially inside the inner shroud and axially adjacent a portion of the outer shroud, and pins extending through such portion and into the outer support ring. The inner support ring or inner shroud has a groove therein bounded by end walls for receiving and being axially abuttable with a locating projection from the adjacent airfoil vane, inner shroud, or inner support ring. The nozzle outer structure may comprise segments each of which has a single protrusion which is axially engageable with the outer support ring or, alternatively, a first and second protrusion which are arcuately and axially separated and which include axial openings therein whereby first and second protrusions on respective, arcuately adjacent nozzle segments have axial openings therein which are alignable with connector openings in the outer support ring and within each of such aligned openings a pin is receivable. The inner shroud may, likewise, comprise segments which, when assembled in operating configuration, have a 360 degree expanse.

2 Claims, 4 Drawing Sheets

Fig. 3A.
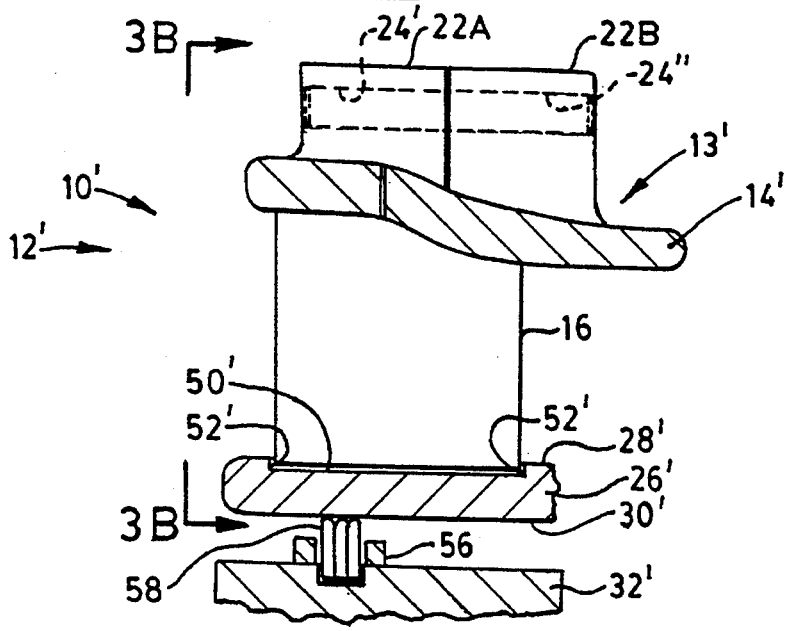
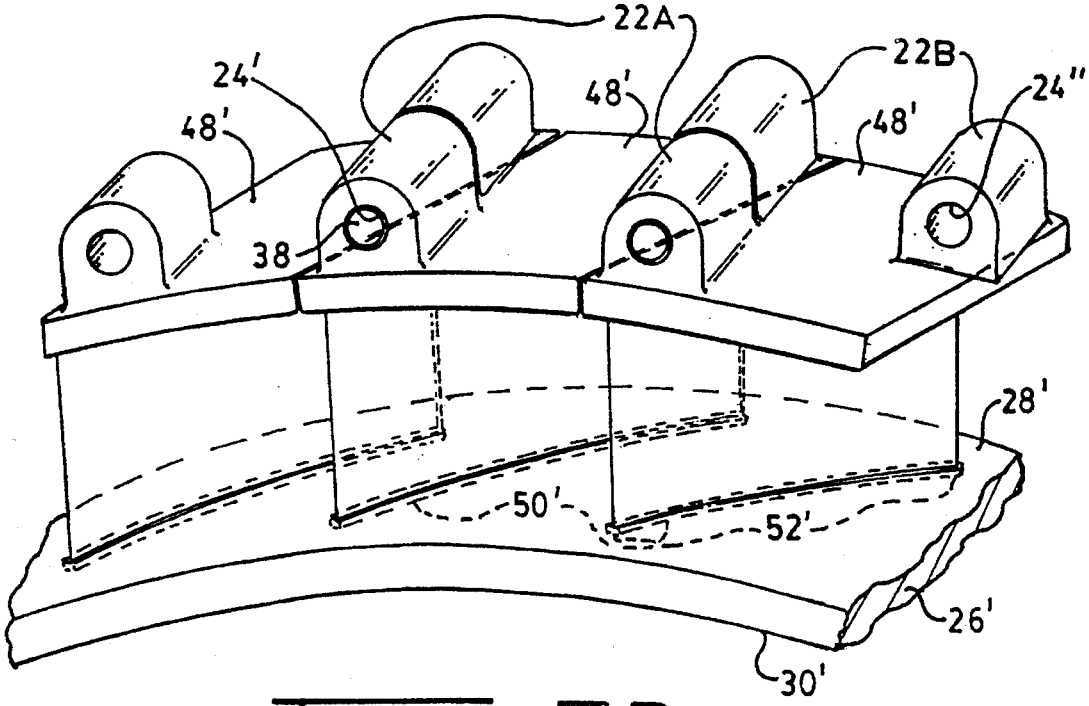
Fig. 3B.

Fig. 4A.
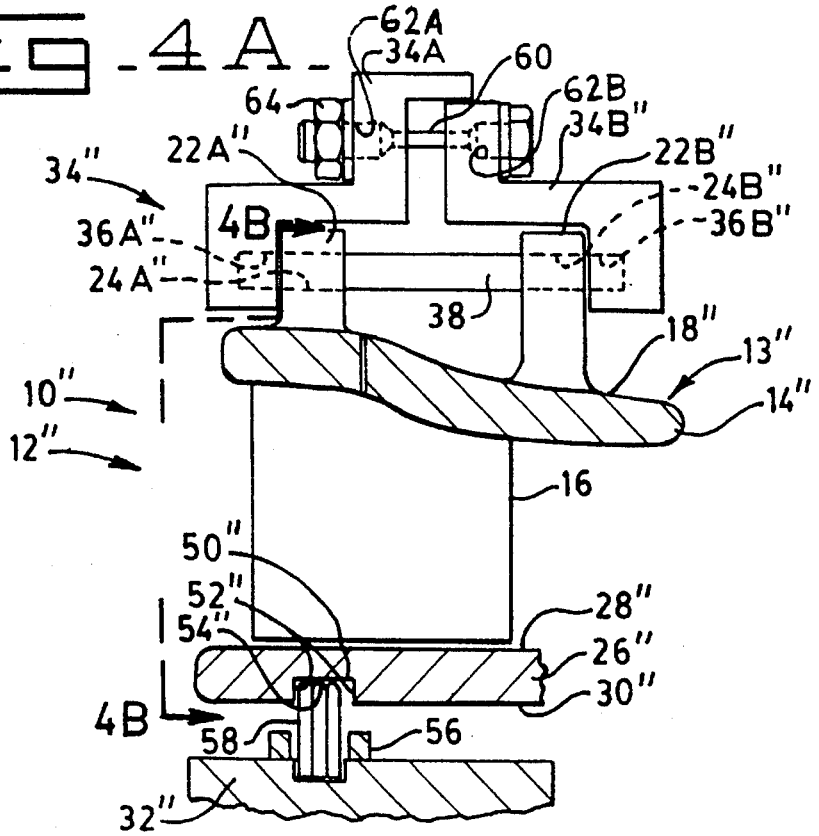
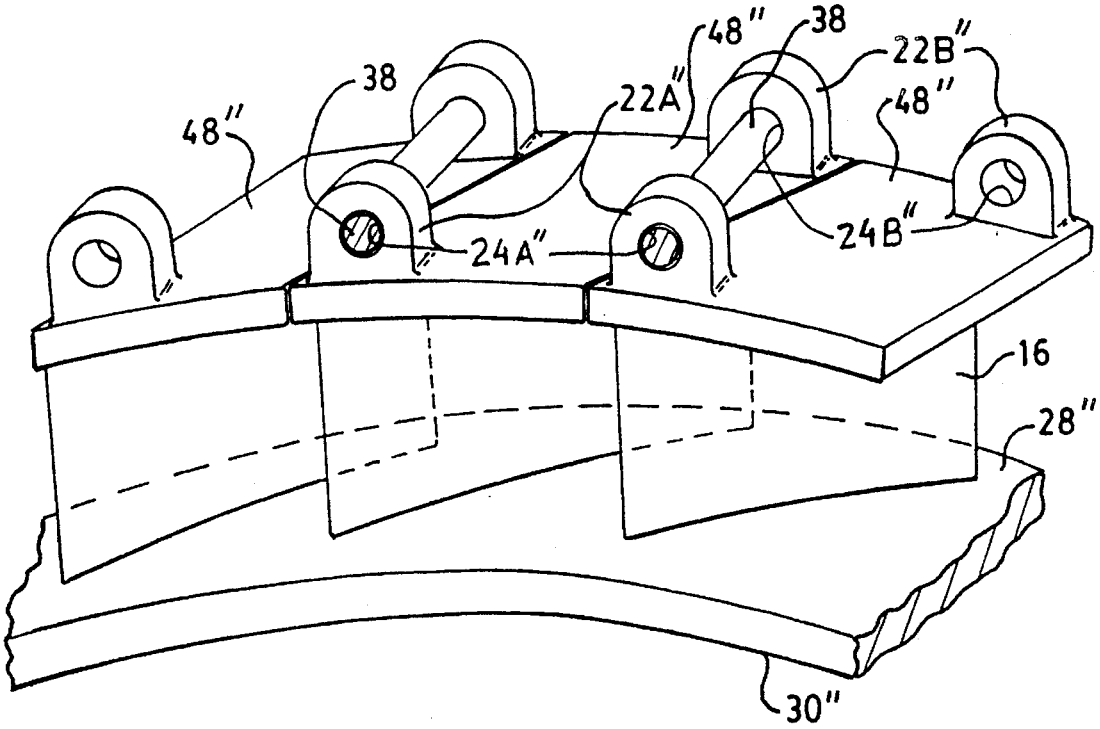
Fig. 4B.

TURBINE NOZZLE/NOZZLE SUPPORT STRUCTURE

The Government of the United States of America has rights in this invention pursuant to Contract No. DE-AC02-92CE40960 awarded by the U.S. Department of Energy.

This is a divisional application of application Ser. No. 08/166,188, filed Dec. 13, 1993, U.S. Pat. No. 5,441,385.

TECHNICAL FIELD

This invention relates to axial flow turbines, and, more particularly to nozzle support structure for use therein.

BACKGROUND ART

In a typical axial flow gas turbine, hot, high pressure working fluid comprising air and products of combustion is transmitted into a turbine nozzle structure which is usually annular in shape. The working fluid accelerates through the nozzle structure in a direction designed to thermodynamically optimize its subsequent engagement with blades mounted on the turbine's rotatable rotor. The turbine nozzle structure, accordingly, is subjected to large pressure loads due to the reduction in static pressure of the working fluid during its acceleration and differential thermal expansion loads resulting from relatively low working fluid temperatures at the radial inner and outer margins of the nozzle structure and relatively high working fluid temperatures intermediate such radial margins. Such turbine nozzle structures have typically been geometrically positioned in their desired location by clamping same between axially adjacent faces of mounting structure.

In the quest for increasing turbine efficiency, working fluid temperature increases have been sought as well as structure to accommodate same. Ceramic nozzle structures have become increasingly favored due to their ability to function satisfactorily in high temperature environments. Ceramic nozzle structures are, however, typically mounted on metallic supporting structures which commonly constitute the majority of structural members in gas turbines. Differential thermal expansion between ceramic nozzle structures and the metallic supporting structures therefor and the resulting high thermal stresses therein virtually prohibit the use of the aforementioned clamping nozzle support structure.

Very recently, however, the assignee of the present invention developed a cantilevered ceramic nozzle structure employing a radially outer shroud having airfoil vanes connected at one end thereto and protruding radially inwardly therefrom and a radially inner shroud which is radially spaced from the free ends of the airfoil vanes.

While such cantilevered nozzle structure substantially reduces the stress induced in nozzle structures by differential thermal expansion as compared to that experienced by conventional nozzle structure components, mounting same to a metallic support structures typically used in today's gas turbines exacerbates the problems encountered in resisting pressure reduced loads thereon since those loads must be reacted entirely through the outer shroud while precisely positioning the connected airfoil vanes in the hot working fluid flow path.

Pins and axial oriented fasteners have frequently been used to mount and fix componentry within gas turbines. German patent 1,035,662, which issued Aug. 7, 1958, used axial pins to join a covering to the outer ends of the rotatable blades in a turbine. U.K. patent 532,372, having a convention date of Aug. 27, 1938, employed pins for fixing arcuately adjacent, rotatable turbine blades to each other. U.S. Pat. No. 4,815,933, which issued Mar. 28, 1989, used pins for connecting conventional turbine nozzles to nozzle supporting seats. The following U.S. Patents used pins to affix turbine nozzles of conventional, integral dual shroud/airfoil vane construction to nozzle support structures: U.S. Pat. No. 4,883,405, which issued Nov. 28, 1989; U.S. Pat. No. 3,363,416, which issued Jan. 16, 1968; and U.S. Pat. No. 5,211,536, which issued May 18, 1993.

To successfully use the cantilevered nozzle structure for accelerating high temperature working fluid therethrough, the nozzle support structure must provide a fixed clearance between arcuately adjacent nozzle segments, a precise axial and radial location for nozzle segments, and a relatively loose attachment joint for frictionally damping certain modes of airfoil vane vibration.

Disclosure of the Invention

There is provided an axial flow turbine having a nozzle structure and nozzle support structure. The nozzle structure includes a nozzle outer structure and an inner shroud. The nozzle outer structure constitutes an outer shroud and airfoil vanes with a protrusion extending radially outwardly from the outer shroud and the airfoil vanes extending radially inwardly from the outer shroud. The inner shroud is radially separated from the airfoil vanes' inner ends. The nozzle support structure includes inner and outer support ring structures respectively arranged axially adjacent to a portion of the inner shroud and axially adjacent to the outer shroud's protrusion, a pin extending through the protrusion and into the outer support ring, and a projection extending into a groove in the inner shroud or inner support ring. The projection constitutes the vanes' inner ends, an appendage from the inner shroud's inner surface, or an appendage from the inner support ring. The nozzle support structure precisely positions the nozzle outer structure, which may constitute a plurality of segments, in desired radial and axial locations.

BRIEF DESCRIPTION OF THE DRAWINGS

FIGS. 3A and 3B are, respectively, a side sectional view of an alternate embodiment of the nozzle support structure and a front, elevational view of such nozzle support structure taken along line IIIB;

FIGS. 4A and 4B are, respectively, a side sectional view of another alternate embodiment of the nozzle support structure and a front, elevational view of such nozzle support structure taken along line IVB.

BEST MODE FOR CARRYING OUT THE INVENTION

Figure 1:
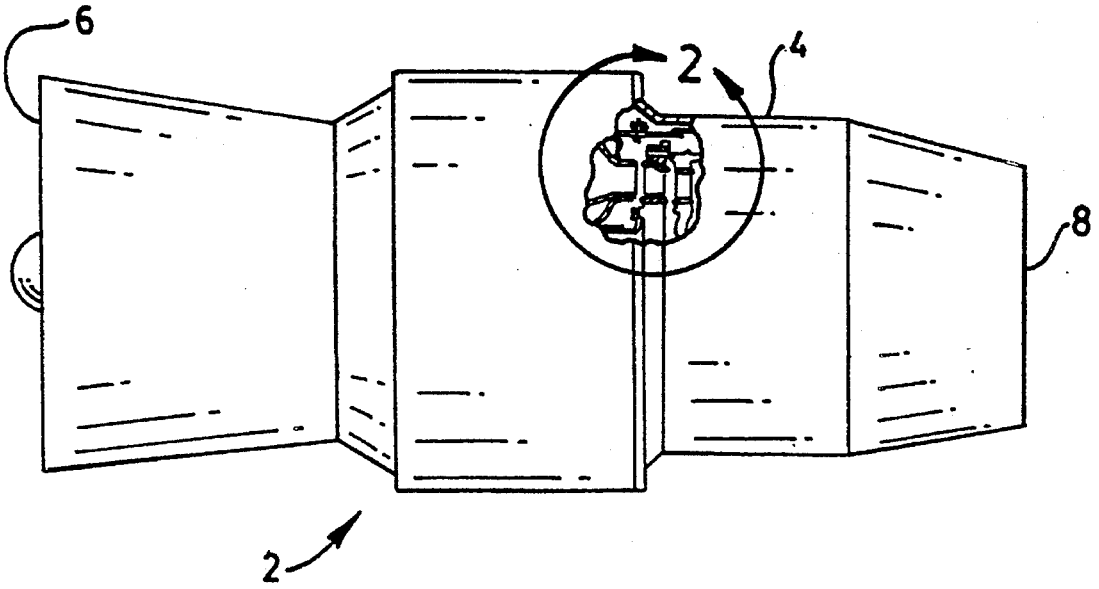
FIG. 1 is a cutaway and partially sectioned view of a gas turbine using a nozzle support structure made in accordance with the present invention.

In the description that follows, it is to be understood that like reference numerals indicate like structure and that primed (') and double primed (") reference numerals indicate structure that is similar to but modified as compared to structure defined by the reference numeral alone.

Referring now to the drawings in detail, FIG. 1 is a cutaway view of a gas turbine 2 having an outer casing 4, an inlet opening 6 for drawing in combustion air, an exhaust opening 8 for expelling the combustion air and products of combustion and, illustrated in the cutout view, a partial sectional view of an inlet nozzle structure 10 and an associated support structure 12. The cutaway view portion 2 of FIG. 1 is better illustrated in enlarged FIG. 2.

The inlet nozzle structure 10 includes a nozzle outer structure 13 and an inner shroud 26. The nozzle outer structure 13 has an outer shroud 14 and airfoil vanes 16. The outer shroud 14 has an outer surface 18, inner surface 20, and a connecting protrusion 22. Each airfoil vane 16 is joined to the inner surface 20, extends radially inwardly therefrom, and has a conventional, airfoil shape/cross section. The connecting protrusion 22 is joined to the outer surface 18, extends radially outwardly therefrom, and has an axial connector opening 24 therethrough. While the nozzle outer structure 13 may comprise an integral member, it preferably includes a plurality of nozzle segments 48 which, when arranged in arcuately adjacent position, form the annular nozzle outer structure 13. The inner shroud 26, disposed radially inside the airfoil vanes 16, preferably comprises a unitized structure and has an outer surface 28 and an inner surface 30 which are respectively facing generally radially outwardly and radially inwardly. Inner surface 20 and outer surface 28 cooperatively form an annular, converging working fluid flow path having airfoil vanes 16 arranged substantially radially thereacross at predetermined arcuate locations. The free, unsupported end of each airfoil vane 16 is radially separated from the outer surface 28.

Figure 2:
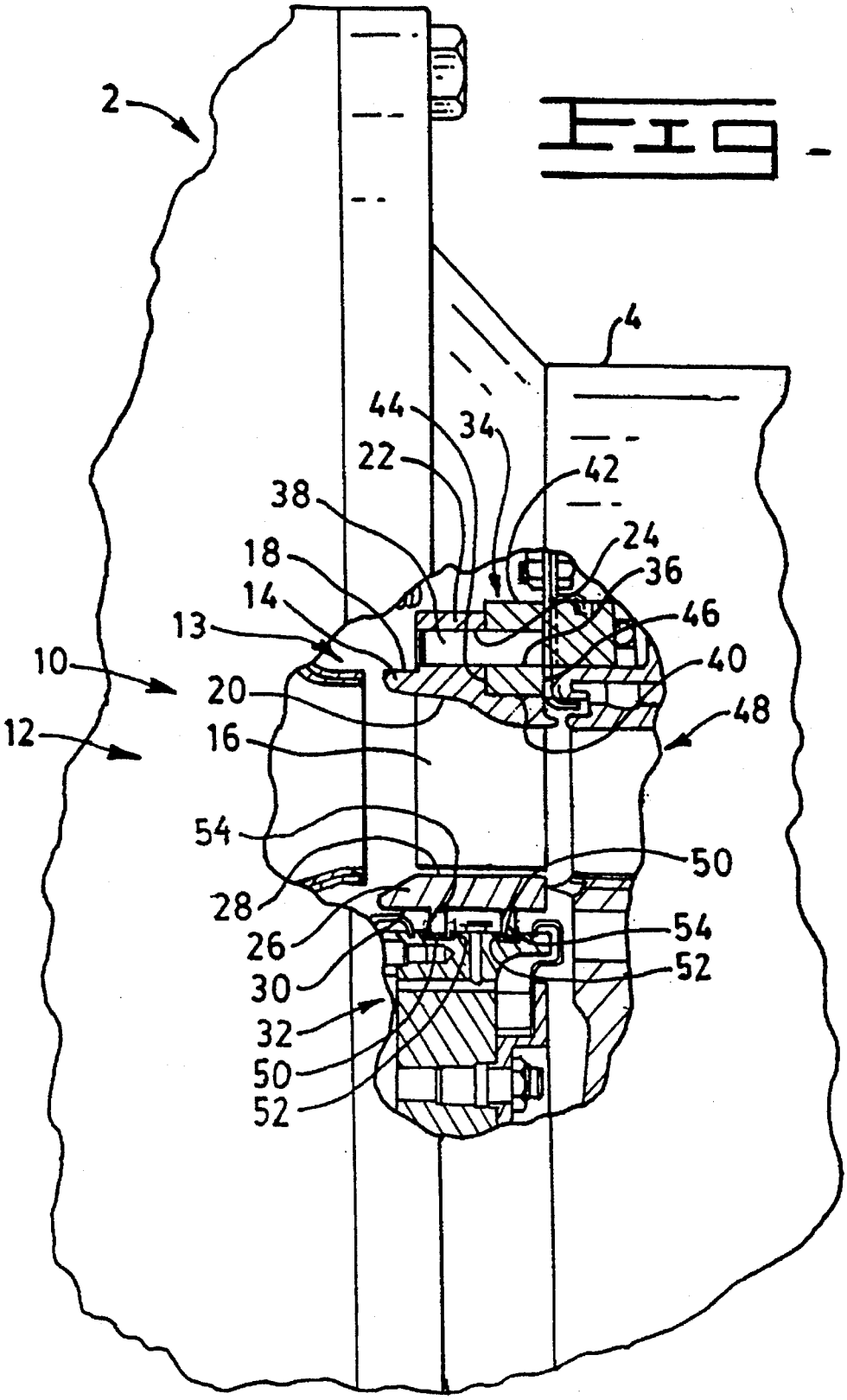
FIG. 2 is an enlarged view of the cutaway portion 2 of FIG. 1.

The nozzle support structure 12 includes an inner, annular support ring structure 32 disposed adjacent the inner shroud 26, an outer support ring structure 34 disposed axially adjacent the connecting protrusions 22 and having arcuately spaced, axial connector openings 36 therein, and pins 38 disposed in aligned connector openings 24 and 36. The outer support ring structure 34 is generally annular in shape and has inner and outer walls 40, 42 and upstream and downstream walls 44, 46. As illustrated in FIG. 2, the outer surface 18 is generally shaped to receive the outer support ring structure 34 and mate with inner wall 40 and upstream wall 44.

The nozzle support structure 12 also includes a pair of grooves 50 in the inner support ring structure 32 with such grooves 50 each having axial end walls 52 and a pair of locating projections 54 which extend from the inner surface 30 in a radially inward direction and into grooves 50 in an axially abutting relationship with the end walls 52. While a pair of locating projections 54 are illustrated, it is to be understood that a single locating projection 54 would also serve to axially locate the inner shroud 26.

FIG. 3A illustrates an alternate embodiment of an inlet nozzle structure 10' and a cooperating nozzle support structure 12' which are, together, suitable substitutes for inlet nozzle structure 10 and nozzle support structure 12. Inlet nozzle structure 10' includes a nozzle outer structure 13' and an inner shroud 26'. The nozzle outer structure 13' has an outer shroud structure 14' including an upstream and a downstream connecting protrusion 22A and 22B which are axially and arcuately separated as best seen in FIG. 3B and airfoil vanes 16 which extend radially inwardly from the outer shroud structure 14'. The inner shroud 26' is disposed radially inside the free, unsupported ends of the airfoil vanes 16 and has an outer surface 28' and an inner surface 30'. A groove 50' in the outer surface 28' includes a pair of axial end walls 52'. The airfoil vanes 16 of inlet nozzle structure 10' extend into the grooves 50' and are axially abuttable with the end walls 52' so as to axially locate the floating, inner shroud 26'.

An inner support ring structure 32' is disposed radially inside the inner shroud 26', is joined indirectly through structural supports (not shown) to the outer casing 4, and includes a seal housing 56 and piston rings 58 or other sealing means which are constrained in seal housing 56. The piston rings 58 extend radially outwardly from the seal housing 56 into engagement with the inner shroud's inner surface 30' to prevent working fluid leakage from the working fluid flow path defined by the inner and outer shroud structures 26' and 14'.

Upstream protrusion 22A has an axial connector opening 24' therethrough while downstream connecting protrusion 22B has an axial connector opening 24" therethrough. When nozzle segments 48' are assembled (as best shown in FIG. 3B) and cooperatively arranged with the outer support ring 34, the connector opening 24' of one segment 48' will align with the connector opening 24" of an adjacent segment 48' and connector opening 36 to permit reception of a pin 38 in such aligned connector openings. As such, each pin 38 in the embodiment shown in FIGS. 3A and 3B engages two nozzle segments 48'. Of course, the protrusions 22A and 22B may be sized and located at any point along the outer surface 18' so as to desirably adjust the frequency of vibration of the nozzle segment 48', advantageously regulate the frictional damping available between arcuately adjacent nozzle segments 48', and limit the magnitude of the bending moments exerted on the nozzle segments 48'.

FIGS. 4A and 4B illustrate another embodiment of an inlet nozzle structure 10" and a cooperating nozzle structure 12". The inlet nozzle structure 10" includes a nozzle outer structure 13" and an inner shroud 26". The nozzle outer structure 13" has an outer shroud structure 14" including an upstream and a downstream connecting protrusion 22A" and 22B", respectively, which are axially and arcuately separated as best seen in FIG. 4B and airfoil vanes 16 which are joined to and extend radially inwardly from the outer shroud structure 14" each terminating at a free, unsupported end. The inner shroud 26" is disposed radially inside the free, unsupported ends of the airfoil vanes 16 and has an outer surface 28" and an inner surface 30". A groove 50" in the inner surface 30" includes a pair of axial end walls 52". The airfoil vanes 16 of inlet nozzle structure 10" extend toward but are separated from the outer surface 28".

An inner support ring structure 32" is disposed radially inside the inner shroud 26", is joined indirectly through structural supports (not shown) to the outer casing 4, and includes a seal housing 56 and piston rings 58 or other sealing means which are constrained in seal housing 56. The piston rings 58 extend radially outwardly from the seal housing 56 into the groove 50" and are axially abuttable with the end walls 52" so as to axially locate the floating, inner shroud 26". The piston rings 58 of FIGS. 4A and 4B also engage with the bottom wall 54" of the groove 50" to prevent working fluid leakage from the working fluid flow path defined by the inner and outer shroud structures 26" and 14".

The upstream connecting protrusion 22A" has an axial connector opening 24A" therethrough while the downstream connecting protrusion 22B" has an axial connector opening 24B" therethrough. While the nozzle outer structure 13" may comprise an integral member, it preferably includes a plurality of nozzle segments 48" which, when arranged in arcuately adjacent position, form the annular nozzle outer structure 13". When nozzle segments 48" are assembled (as best shown in FIG. 4B) and cooperatively arranged with the outer support ring structure 34", the connector opening 24A" of one segment 48" will align with the connector opening 24B" of an adjacent segment 48" and connector opening 36B" to permit reception of a pin 38 in such aligned connector openings 24A", 24B", 36B". Accordingly, each pin 38 in the nozzle/nozzle support structure's embodiment shown in FIGS. 3A, 3B engages two nozzle segments 48".

The outer support ring structure 34" has a front support ring 34A" and a rear support ring 34B" which have, respectively, a plurality of connector openings 36A" and 36B" After each pin 38 is inserted as described above, the front ring 34A" is assembled with the rear ring 34B" such that the connector openings 36A" receive the upstream ends of the pins 38. Subsequently, each of a plurality of bolts 60, disposed through securement openings 62A and 62B respectively formed in front ring 34A" and rear ring 34B", have a nut 64 assembled therewith and suitably tightened thereon to capture the pins 38 and each nozzle segment 48" mounted thereon between the rings 34A" and 34B".

Industrial Applicability

In operation, each nozzle segment 48, 48' and 48" is accurately secured in place by pin(s) 38. In the preferred embodiment, one pin 38 holds each nozzle segment 48 in location while the outer support ring structure 34 mates with the outer surface 18 and the axially adjacent connecting protrusion 22 to prevent "rocking" about the centerline of the pin 38. In FIGS. 3A, 3B, 4A, and 4B, no rocking motion about any pin 38 is permitted due to each nozzle segment 48' and 48" having a pair of pins 38 connecting that nozzle segment to the outer support ring structure 34', 34".

Suitable registration/locating of the inner shroud 26, 26' and 26" relative to the nozzle segment 48, 48' and 48" obtains by three means respectively illustrated in: FIG. 2; FIGS. 3A, 3B; and FIGS. 4A, 4B. The registration/locating means generally includes: a groove 50, 50' and 50" respectively formed on the inner support ring 32, the outer surface 28' of shroud 26', and the inner surface 30" of shroud 26"; and a locating projection 54, 16, 58 extending into the corresponding groove and being axially abuttable with the groove's end walls 52, 52', and 52". When the groove 50 is formed in the inner support ring 32, the projection comprises at least one appendage 54 extending from the inner shroud's inner surface 30. When the groove 50 is formed in the outer surface 28 of the inner shroud 26, the radially inner ends of the airfoil vanes 16 constitute the projection. When the groove 50" is formed in the inner shroud's inner surface 30", the projection constitutes piston rings 58 or other appendage(s) extending radially outwardly from the associated inner support ring 32". In all cases, however, such projection axially fixes the inner shroud 26, 26', 26" relative to the corresponding nozzle segment 48, 48', 48" so as to form an annular, converging nozzle between the inner and outer shrouds and cause the working fluid, during its flow therebetween, to accelerate. The airfoil vanes 16, disposed radially across such nozzle, arcuately direct the working fluid to facilitate its entry into rotatable turbine blades.

It is to be understood that, within the purview of the present invention, the airfoil vanes 16 may be integral with the inner shroud 26, 26', 26" rather than joined to the nozzle outer structure 13, 13', 13" and the elements of the support structure 12, 12', 12" may be reversed such that the nozzle outer structure and inner shroud are supported as is respectively illustrated for the inner shroud and nozzle outer structure.

It should now be apparent that a nozzle support structure 12, 12', 12" for a cantilevered, annular inlet nozzle structure 10, 10', 10" has been provided which maintains a fixed clearance between arcuately adjacent nozzle segments 48, 48', 48", accurately locates in an axial and radial plane such nozzle segments and the associated inner shroud 26, 26', 26", has a relatively loose attachment joint to accommodate frictional damping of airfoil vane vibration modes, and permits the use of an integral inner shroud 26, 26', 26" by closely controlling the airfoil vane's length. Use of pins 38 to accurately locate the nozzle segments minimizes heat conduction from the nozzle structure to the outer support ring, minimizes machining to ceramic surfaces, and permits the arcuate clearance between nozzle segments on outer shrouds to be minimized so as to prevent working fluid leakage out of the flow path. Additionally, the inlet nozzle structure 10, 10' and 10" as well as the nozzle support structure 12, 12' and 12" permit existing turbines to be retrofitted with ceramic inlet nozzle componentry without requiring undue structural modification thereof.

We claim:

1. A turbine nozzle support structure comprising:

an outer, annular support ring structure having a plurality of accurately spaced, axial connector openings therein, said outer support ring comprising a first and second axially adjacent clamping rings having respective first and second clamping surfaces which are respectively engageable with said first and second connecting protrusions;

a nozzle outer structure disposed in closely spaced relationship with said outer support ring and including, an outer shroud having a radially inward surface, a radially outward surface, at least one connecting protrusion extending radially outwardly from said outward surface and having an axial connector opening therethrough being generally aligned with one of the axial connector openings in the outer, annular support ring, and a plurality of airfoil vanes extending radially inwardly from said inward surface for a predetermined distance and each having an unsupported inner end, said plurality of airfoil vanes being joined to the inward surface;

an inner, annular support ring structure disposed in free and unsupported spaced relation with said airfoil vanes;

an annular inner shroud disposed between said inner support ring structure and said airfoil vanes' inner ends, said annular inner shroud having an inner and an outer surface;

at least one of said inner support ring structure, inner shroud's outer surface, and inner shroud's inner surface having a groove therein which is bounded by end walls;

a locating projection extending into axial relationship with said end walls, said projection comprising at least one of (i) said vanes' inner ends, (ii) an appendage extending from said inner shrouds' inner surface, and (iii) an appendage extending from said inner support ring; and a pin disposed in a connector opening of said outer support ring structure and an aligned connector opening of the nozzle outer structure.

2. The nozzle/nozzle support structure of claim 1 wherein said outer support ring's connector openings are disposed in said clamping surfaces, said connector openings on one clamping surface being respectively aligned with connector openings on the other clamping surface.

* * * * *